United States Patent [19]

Mussulman

[11] 4,044,644

[45] Aug. 30, 1977

[54] PIANO

[76] Inventor: Charles E. Mussulman, 2 E. Main, Chanute, Kans. 66720

[21] Appl. No.: 626,217

[22] Filed: Oct. 28, 1975

Related U.S. Application Data

[62] Division of Ser. No. 477,295, June 7, 1974, Pat. No. 3,923,939.

[51] Int. Cl.[2] ..... G10C 3/10

[52] U.S. Cl. ..... 84/207; 84/312

[58] Field of Search ..... 84/207, 312

[56] References Cited

U.S. PATENT DOCUMENTS

| | | | |
|---|---|---|---|
| 461,217 | 10/1891 | Haake | 84/207 |
| 3,890,872 | 6/1975 | Sjostrand | 84/207 |

FOREIGN PATENT DOCUMENTS

| | | | |
|---|---|---|---|
| 9,085 | 7/1839 | United Kingdom | 84/207 |
| 8,164 | 6/1888 | United Kingdom | 84/207 |

*Primary Examiner*—Lawrence R. Franklin
*Attorney, Agent, or Firm*—D. A. N. Chase

[57] ABSTRACT

An electric piano, using only one string per note and no soundboard, employs special mechanical and electrical means capable of controlling all of its various characteristics in order to duplicate the sound and other characteristics of a conventional piano. A floating bridge, floating on the strings and supported solely thereby, is used not for the pickup or transfer of string vibrations to any other device, but to control the characteristics of the string vibrations. Magnetic pickups consisting of a series of coils with adjustable permanent-magnet cores are arranged in special positions along the active lengths of corresponding strings and, in conjunction with frequency responsive capacitor circuitry, convert the vibration of each string into an electrical signal, shape the signal, and provide a composite signal output containing all the tone characteristics needed to produce a true piano sound. One end of each string is attached by a slip proof connection to an independent tuning bar mechanism employing a rocker bar on a fulcrum, the bar position being precisely controlled for both coarse and fine tuning.

3 Claims, 15 Drawing Figures

Fig. 8.
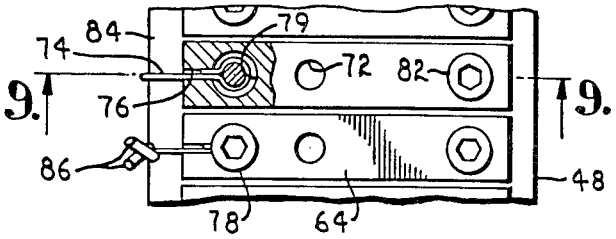
Fig. 4.
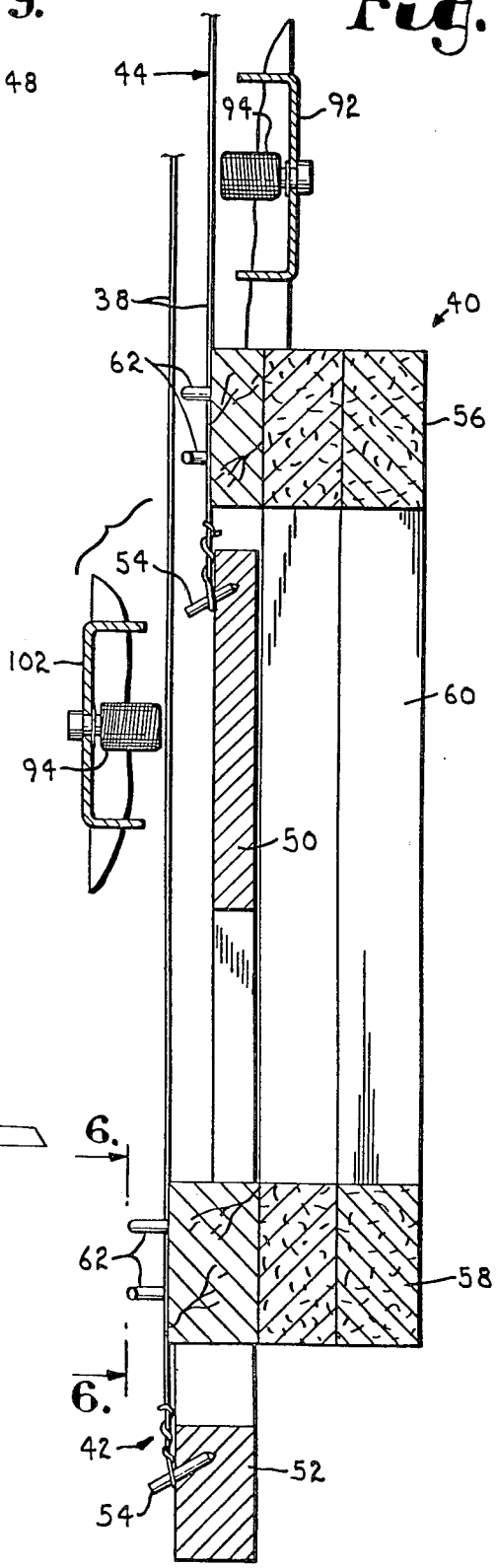
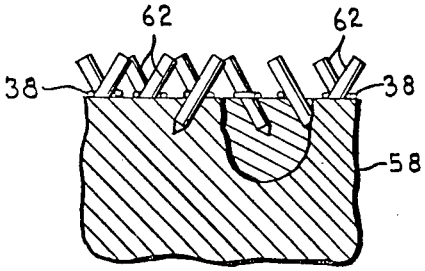
Fig. 7.
Fig. 5.
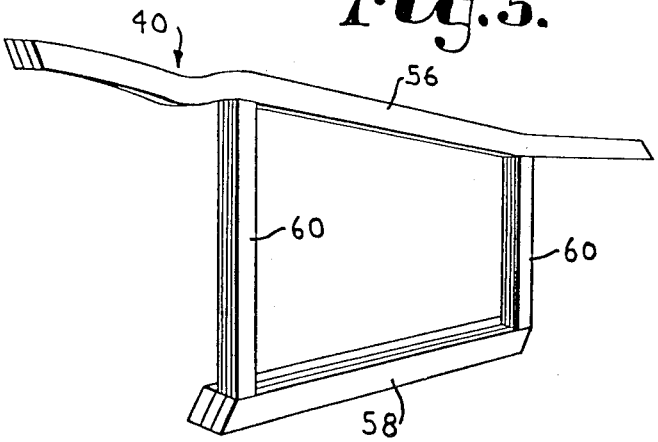

PIANO

This is a division of application Ser. No. 477,295, filed June 7, 1974, now U.S. Pat. No. 3,923,939.

This invention relates to novel mechanical and electrical apparatus used in conjunction with the strings, harp, hammers, action and keyboard of an electric piano to derive from the strings a vibration which is, in turn, converted to an electrical signal that contains all the tone, attack and decay, touch response, and sustain characteristics of a conventional piano. Through the use of only one string per note and no soundboard, the harp, frame, case and thus the entire piano is but a fraction of the size and weight of a conventional piano.

In an attempt to construct an electric piano of small size and weight which has the true sound, touch response, attach and decay, and sustain characteristics of a conventional piano, many problems and failures have resulted. Whether employing strings, reeds or electronic devices, difficulties have been encountered due to the complex wave characteristics of the piano sound as every note has its own unique and complex wave form. String pianos have had the wrong mixture of fundamental and harmonic frequencies and an incorrect amplitude balance of all the notes in the spectrum due to the string generating the incorrect wave form and the prior practice of sensing the vibrations at the speaking end of the string. Reed pianos suffer from the disadvantage that reeds contain few if any harmonics and have improper attack and decay characteristics. A pure electronic piano without hammers or vibratory members does not have the proper attack and decay, and has no touch and response qualities whatsoever.

The disadvantage of the conventional piano is its size and weight, which is largely attributed to the massive harp that is required to support the double and triple strings employed for each note over the major portion of the keyboard spectrum. Besides size and weight, a conventional piano is also difficult to tune and is subject to changes in temperature, atmospheric pressure and humidity. Constant retuning is required for the discriminating artist. A major cause of this sensitivity is the wooden soundboard to which the bridge is glued, as the soundboard may expand or contract with temperature changes or swell with humidity, thereby changing the pressure placed on the strings that are drawn over the bridge. Furthermore, skill is required in tuning the piano due to the use of the double and triple strings which are tied to tuning pins that must be rotated by hand to adjust the tension.

It is, therefore, an important object of the present invention to provide an electric piano of relatively light weight and small size which is capable of producing a sound of true piano quality.

As a corollary to the foregoing object, it is an important aim of this invention to provide an electric piano as aforesaid that is capable of producing the true tone, attack and decay, touch response, and sustain characteristics of a conventional piano which, because of the use of multiple strings per note and a soundboard, requires a massive, large and heavy harp, frame and case.

Another important object of this invention is to provide an electric piano as aforesaid employing a floating bridge to both impart a piano-like vibratory motion to each string with desired harmonic, attack and decay, touch response, and sustain characteristics, and render the tuning of the piano insensitive to temperature, atmospheric pressure and humidity changes.

Still another important object of the invention is to provide electrical apparatus utilized in conjunction with the floating bridge arrangement to control the harmonic characteristics of the tones produced. To this end, it is a specific aim of the invention to provide wave shaping through the employment of pickup devices particularly positioned along the active lengths of the piano strings for sensing vibration thereof, and variable harmonic suppression of the signals produced by such pickups in order that the signals, whem amplified, provide a musical sound of true piano quality.

Furthermore, it is an important object of the present invention to provide an adjustment mechanism for precisely setting the tension in each of the strings of a piano, wherein such mechanism makes a slip proof connection with the string and is capable of making a fine adjustment using a simple tool such as an Allen wrench.

Additionally, it is an important object to provide an adjustment mechanism as aforesaid which is also capable of making rough as well as fine adjustments, these objectives being implemented by the employment of a tuning bar in the nature of a rocker which is precisely positioned on its fulcrum to control the string tension.

In the drawings:

FIG. 4 is a greatly enlarged, fragmentary, cross-sectional view taken along line 4—4 of FIG. 2 and showing the overstrung string arrangement, associated pickups and the floating bridge;

FIG. 5 is a rear perspective view, on a smaller scale, of the floating bridge per se;

FIG. 7 is a cross-sectional view taken along line 7—7 of FIG. 6, a portion of the bridge being broken away to reveal two of the upper pins in detail;

FIG. 8 is a fragmentary, top plan view of the bank of tuning bars for adjusting the tension of the strings, on a larger scale than FIG. 3;

THE PIANO STRUCTURE

Figure 1:
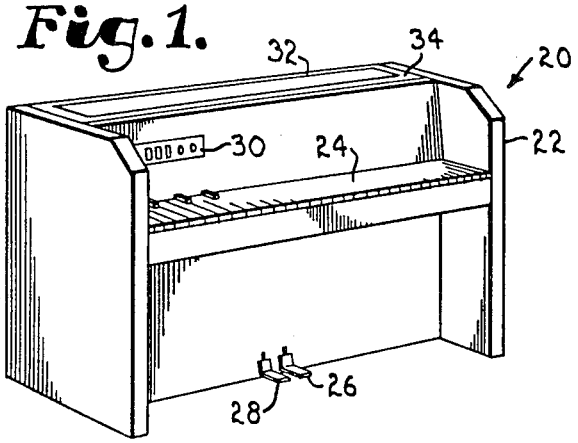
FIG. 1 is a front perspective view of the piano.

Referring initially to FIGS. 1-7, the piano of the present invention is broadly denoted by the numeral 20 and has the usual case 22, keyboard 24, and sustain and soft pedals 26 and 28 respectively (FIG. 1). The embodiment herein is designed with portability being a primary factor; thus a shortened keyboard with 64 keys is employed. The piano employs a conventional audio amplifier without special preamplification, and other electrical apparatus to be subsequently described. A control panel 30 for the amplifier and a speaker opening 32 in the cover 34 of the case 22 are visible in FIG. 1; an external amplifier may be used instead if desired.

Figure 2:
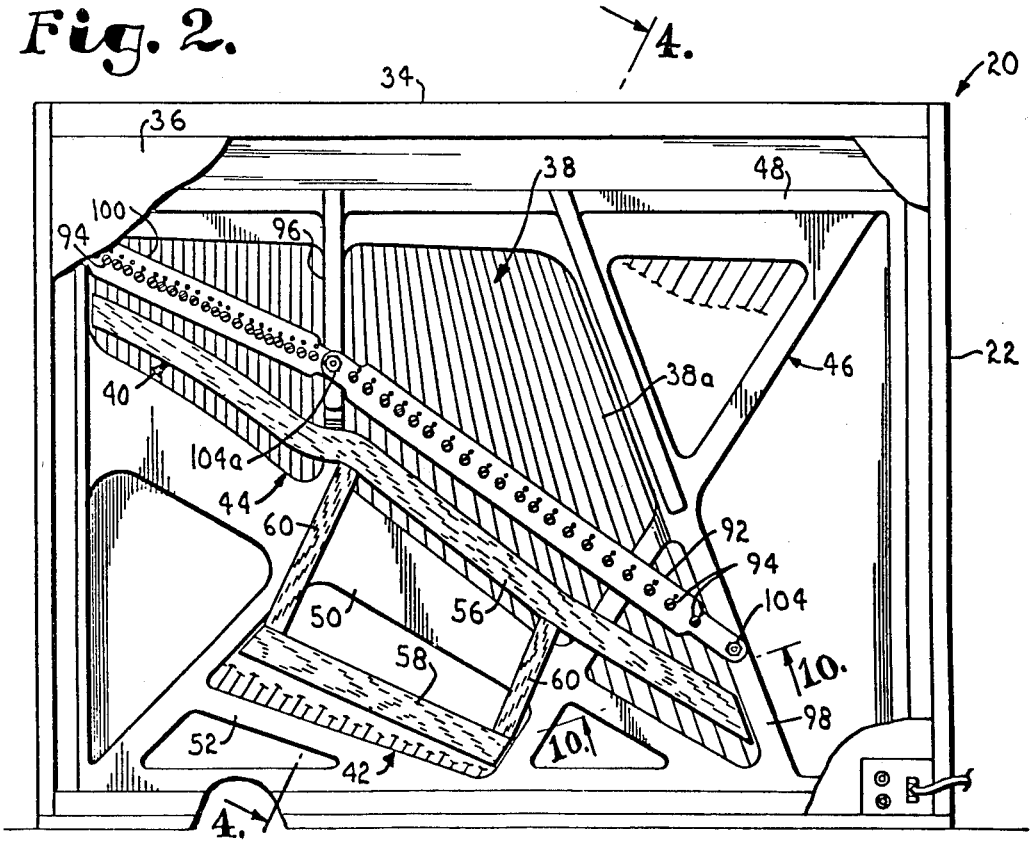
FIG. 2 is a rear elevational view of the piano with the rear panel of the case being broken away to reveal the interior construction, and with the bass strings also broken away for clarity.

In FIG. 2 the rear panel 36 of the case 22 is broken away to reveal a bank of 64 piano strings 38 and a floating bridge 40. Each string 38 is of the usual steel wire construction and is in engagement with the bridge 40 as best illustrated in FIG. 4. It should be noted that one string 38 is provided for each key of the keyboard 24 or each note of the piano 20. The bank of strings 38 is overstrung in that the group of 23 bass strings 42 overlaps the group of 41 treble and mid-range strings 44. As a matter of reference, the middle C string is the twenty-eighth string from the bass end and is noted by the reference numeral 38*a*.

The strings 38 are supported at their ends by a metal harp or frame 46 of light weight but otherwise similar to a type used in conventional piano construction. The harp 46 has a generally horizontal top member 48 supporting the upper ends of all of the strings 38 (to be described), an intermediate, diagonal member 50 to which the lower ends of the treble and mid-range strings are secured, and a relatively short bottom member 52 to which the lower ends of the bass strings are secured. The diagonal member 50 and the bottom member 52 may be seen in FIG. 4 (in cross section) as well as FIG. 2. FIG. 4 clearly reveals the overlapping relationship of the bass string group 42 and the treble and mid-range string group 44, two strings 38 of the respective groups being illustrated. Pins 54 of brass or the like are secured in mating openings in the harp members 50 and 52 by an interference fit, and are disposed at an angle as illustrated to serve as binding posts for attachment of the lower ends of the strings 38.

Referring particularly to FIGS. 2 and 5, the floating bridge 40 has an elongated, upper, primary span 56 disposed slightly above and in general parallelism with the diagonal harp member 50. A shorter, secondary span 58 is spaced below the primary span 56 and is generally parallel thereto, the two spans 56 and 58 being rigidly interconnected by a pair of cross members 60. As best seen in FIG. 4, each of the spans 56 and 58 is of laminated, wooden construction. Three layers are employed, the outer two layers (away from the strings 38) being composed of particle board and the inner layer being a suitable hardwood such as maple. Each layer is approximately one inch in thickness with the maple lamination being somewhat less than and somewhat greater than one inch for the primary and secondary spans 56 and 58 respectively, in order to accommodate the overstrung arrangement and space the bass string group 42 inwardly from the adjacent strings of the treble and mid-range group 44. The cross members 60 may also be composed of particle board and the entire bridge assembly is held together as a rigid structure by suitable glue or cement.

Figure 6:
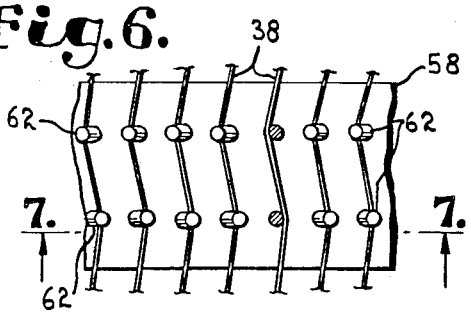
FIG. 6 is a fragmentary, enlarged, elevational view taken along line 6—6 of FIG. 4.

The bridge 40 floats in that it exerts no external lateral forces on the strings 38, is solely supported thereby, and does not touch the harp or other components of the piano construction. The strings 38 are under great tension and engage the respective bridge span at the inner facing formed by the maple lamination. With reference to FIGS. 4, 6 and 7, a pair of bridge pins 62 serve to secure each string 38 to the respective bridge span 56 or 58; these pins 62 are set an angles to form a V-shaped passage for each string as viewed in FIG. 7. In FIG. 6 it may be seen that the pins 62 of each pair are aligned as they emerge from the surface of the bridge (one pair is shown in cross-section at the plane of the bridge surface), but that the opposite angular positions of the pins cause the string 38 to be drawn around the pins in order to hold the string in tight engagement with the bridge surface. The group of bass strings 42 are secured exclusively to the secondary bridge span 58, and the group 44 of treble and mid-range strings are secured exclusively to the primary span 56.

Figure 3:
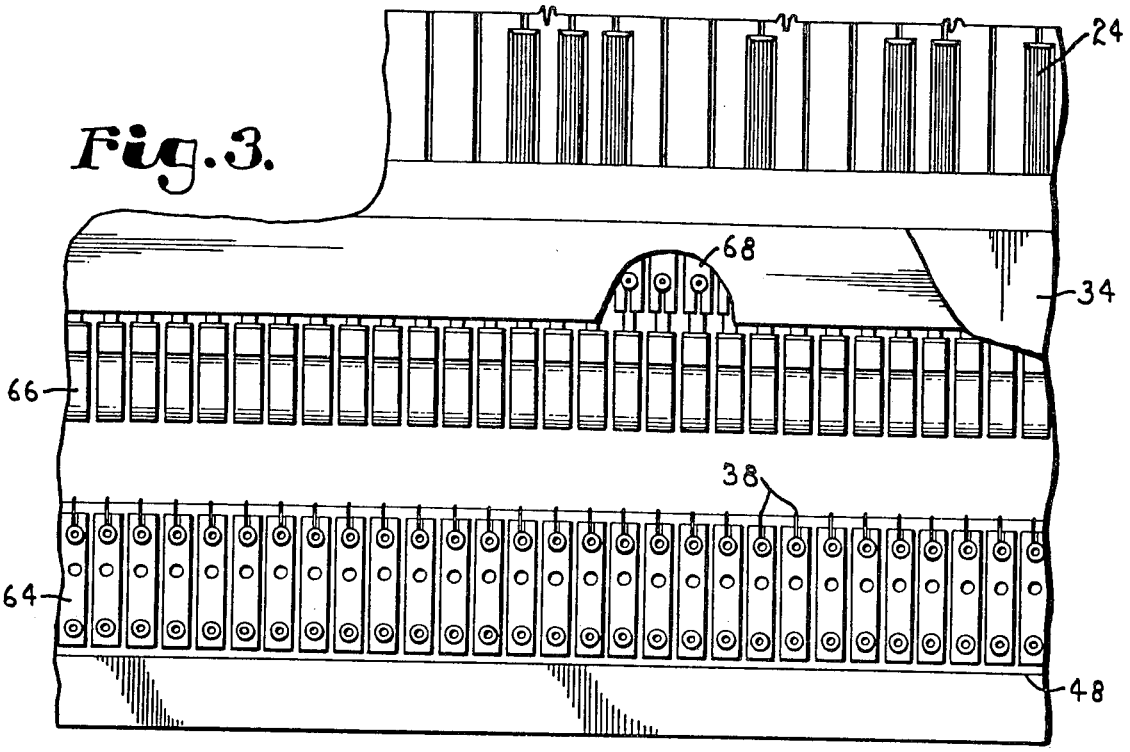
FIG. 3 is an enlarged, fragmentary, top plan view of the piano of FIG. 2 with the cover broken away.

Referring to FIG. 3, the upper ends of all of the strings 38 are attached to a bank of tuning bars 64. As will be discussed, individual tuning bar mechanisms are provided for the strings 38 for the purpose of controlling the tension of the strings in order to set the fundamental frequency of vibration of each. A bank of felt covered hammers 66 oppose corresponding strings 38 adjacent their upper ends at the appropriate point as in conventional piano design, each of the hammers 66 being part of a conventional piano hammer and damper action (not shown). The individual hammers 66 are operated by corresponding keys of the keyboard 24 in the usual manner via conventional operating levers and linkages of the action shown fragmentarily at 68. Rather than the hammers of standard thickness illustrated, a thin hammer on the order of one-third the thickness and with reduced striking force may be employed to avoid grooving the felt to the point that the hammer is destroyed.

TUNING BAR MECHANISMS

Figure 9:
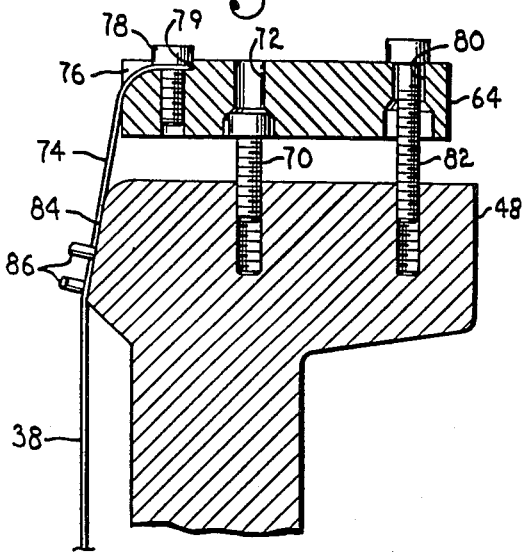
FIG. 9 is a vertical sectional view taken along line 9—9 of FIG. 8, revealing one of the tuning bar mechanisms and associated string.

Referring particularly to FIGS. 8 and 9, each tuning bar 64 is in the nature of a rocker supported on the head of a threaded component 70, preferably a socket head cap screw as illustrated. A through hole 72 in the bar 64 is located intermediate the ends thereof and is counterbored at its lower end to receive the head of the screw 70, such head providing a fulcrum for the rocker bar 64. The top member 48 of the harp 46 serves as a base for the bank of tuning bars 64, and tapped openings in the member 48 receive the various screws 70 as is clear in FIG. 9.

The individual tuning bar mechanisms are identical and operate independently. One of the mechanisms is shown in detail in the cross-sectional illustration provided by FIG. 9, where it may be seen that the upper end 74 of the associated string 38 is received within a slot 76 in the top of the adjacent end of the tuning bar 64. A cap screw 78 is threaded into the bar 64 at the inner end of the slot 76 to provide a post around which the wire string is wrapped. The cap screw 78 is tightened to capture the string end 74 securely within the slot 76 in a cavity formed under the head of screw 78 in the recess 79 which partially receives the head.

The opposite end of the tuning bar 64 is provided with an opening 80 therethrough which loosely receives the shank of a threaded element 82, preferably a socket head cap screw of the same type as screw 70.

The screw 82 is threaded into a tapped opening provided in the top member 48; the diameter of the upper portion of the opening 80 is reduced so that the bar 64 is retained beneath the head of the screw 82.

The top member 48 is formed with a shoulder 84 over which the end 74 of the string 38 is drawn. A pair of guide pins 86 in the shoulder 84 serve to both guide the string thereover and insure positive engagement of the string with the surface of the shoulder; these pins 86 are set at an angle in opposite directions to form a V as viwed in FIG. 8, much in the same manner as the guide pins 62 employed to secure the strings to the floating bridge 40. The active or speaking length of each of the strings 38 is defined, at the lower end, by the zone of engagement of the string with the bridge span 56 or 58 and, at the upper end, by the supported end 74 of the string as it passes over and engages the shoulder 84. Accordingly, from an acoustical standpoint, the length of each string 38 is that portion thereof between the bridge span 56 or 58 and the shoulder 84 thereabove.

In the embodiment of the tuning bar mechanism illustrated in FIGS. 8 and 9, the center cap screw 70 serves as a rough adjustment and the end screw 82 provides a fine adjustment of string tension. In the modified form of tuning bar mechanism shown in FIGS. 14 and 15, the center screw 70 is replaced by a fixed fulcrum in the form of an upstanding, integral ridge 88 received within an inverted, shallow, V-shaped recess 90 in the underside of the tuning bar 64*a*. As is clear in FIG. 15, the ridge 88 is of inverted, V-shaped configuration but the V is sharper than the recess 90 to permit free rocking movement of the bar 64*a* on the fulcrum thus presented. The components of the modified mechanism are otherwise identical to the embodiment of FIGS. 8 and 9, like components being identified by the same reference numerals with the addition of the *a* notation.

Figure 14:
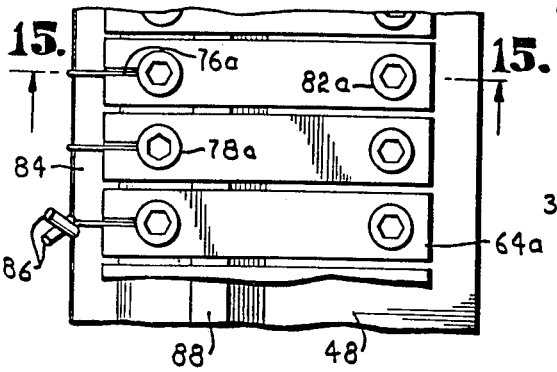
FIG. 14 is a fragmentary, top plan view similar to FIG. 8, but showing a modified form of tuning bar mechanism.
Figure 15:
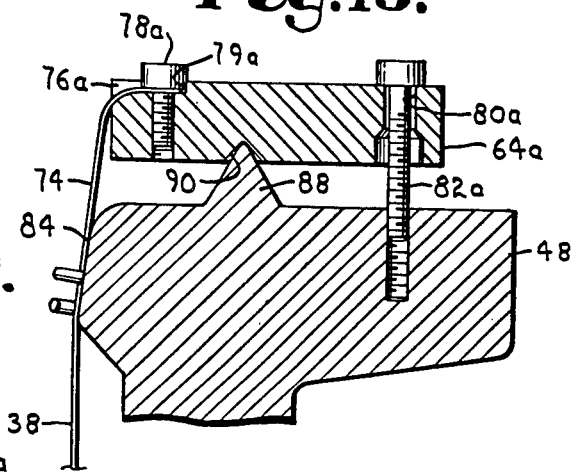
FIG. 15 is a vertical sectional view taken along line 15—15 of FIG. 14, revealing one of the modified tuning bar mechanisms and associated string.

It should be understood that, for clarity of illustration, only one pair of guide pins 86 is shown in FIGS. 8 and 14. As described above, a pair of such pins 86 in the shoulder 84 is employed with each of the strings 38.

ELECTRICAL APPARATUS

Referring first to FIGS. 2 and 4, an elongated bracket 92 carries a series of 20 mganetic pickups 94 and is mounted at its ends on frame members 96 and 98 of the harp 46. A second elongated bracket 100 carries a series of 21 pickups 94 and is mounted at its ends on frame member 96 and the upper lefthand corner of the harp structure (hidden from view in FIG. 2 by the panel 36). The 41 pickups carried by the two brackets 92 and 100 are disposed along the active length of the corresponding strings 38 of the treble and mid-range group 44, these pickups 94 being spaced above the primary bridge span 56 by the brackets 92 and 100.

The brackets 92 and 100 are of like construction except as to length, and it may be seen in FIG. 4 that the same are of channel-shaped configuration as viewed in transverse cross-section. FIG. 4 also reveals a third bracket 102 hidden from view in FIG. 2 by the diagonal harp member 50; this bracket 102 is likewise mounted at its ends on the harp structure and carries a series of 23 pickups 94 corresponding to the 23 strings of the bass group 42.

Figure 11:
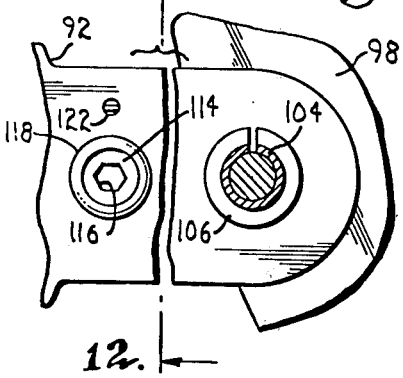
FIG. 11 is a fragmentary, rear elevational and cross-sectional view taken along line 11—11 of FIG. 10.
Figure 10:
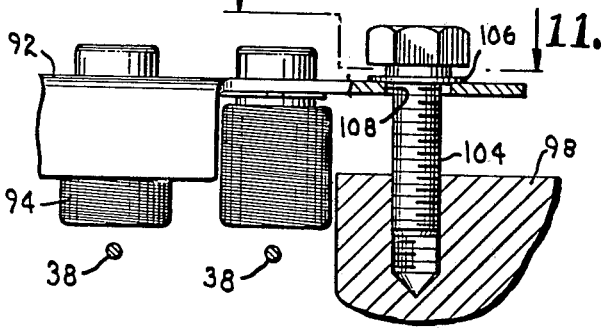
FIG. 10 is an enlarged, fragmentary, cross-sectional view taken along line 10—10 of FIG. 2 and illustrates the adjustable mount for one of the brackets that carries the pickups.

The manner of mounting the pickup brackets on the harp is illustrated in FIGS. 10 and 11 where one end of the bracket 92 is shown in detail. A cap screw 104 is threaded into the frame member 98 and has a collar 106 retained under the head of the screw 104 on an unthreaded portion of the screw shank. The end of the bracket 92 is provided with a hole 108 through which the screw 104 extends, the end of the bracket being secured to the collar 106 by solder or a weld. The shank of the screw 104 turns within the collar 106 but the latter is retained under the head; thus the bracket 92 and accompanying pickups 94 move toward and away from respective strings 38 as the screw 104 is threaded into the frame member 98 or withdrawn therefrom. The same adjustable mount is provided at the opposite end of bracket 92 and at the ends of the other brackets 100 and 102, with a common mounting screw 104*a* being used for the right and left ends of brackets 100 and 92, respectively, as viewed in FIG. 2.

Figure 12:
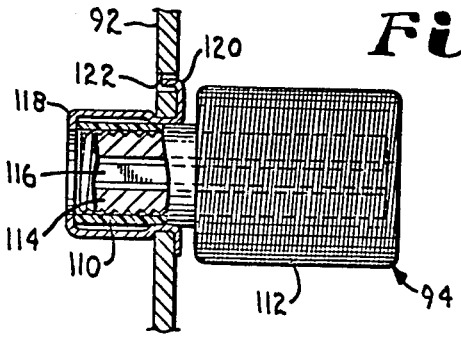
FIG. 12 is a further enlarged, fragmentary, cross-sectional view taken along line 12—12 of FIG. 11, a portion of the pickup being broken away to reveal details of construction.

One of the magnetic pickups 94 is shown in detail in FIG. 12. An insulated tube 110 provides a form for a coil 112 that surrounds a permanent magnet core 114. The tube 110 is provided with internal threads that receive mating external threads on the core 114, the latter having a hexagonal center passage 116 for receiving a wrench (not shown) so that the location of the core 114 along the axis of the coil 112 may be adjusted. The closer the outer end of the core 114 is spaced from the string 38, the greater the sensitivity of the pickup to the vibratory motion imparted to the string when it is struck by the corresponding hammer 66. The pickup may be secured to the bracket by any suitable means, such as the press-fit cap 118 received within a mating opening in the bracket and provided with an alignment lug 120 retained within a properly positioned hole 122 in the bracket.

In order to assist the piano of the present invention in the production of tones of true piano quality with the characteristic harmonic mixture and content, it should be understood that the pickups 94 are particularly positioned along the active lengths of the respective strings 38. For the lowest bass string the associated pickup 94 is located at approximately the one-eighth point from the proximal edge of the bridge span 58 engaged by the string, meaning that the pickup 94 is disposed to sense the vibratory motion of the string occurring at approximately one-eighth the distance along its active length from the bridge span 58 to the upper supported end of the string, which terminates acoustically at the shoulder 84. At the highest string 38, however, the associated pickup 94 is positioned to sense the string at approximately the mid point of its active length. The 62 intermediate pickups 94 are positioned progressively more toward the mid point from the low end to the high end of the spectrum at uniform intervals expressed as an incrementally increasing fraction of active string length, i.e. increasing with each higher string by an amount equal to the difference between the high end and the low end positions ($\frac{1}{2} - \frac{1}{8} = \frac{3}{8}$) divided by 62. Accordingly, the pickups associated with the group 42 of bass strings are disposed at points beginning at the one-eighth point for the lowest string and progressing to somewhat greater spacing from the bridge span 58 relative to the active lengths of the strings, and this continues throughout the group 44 of middle and treble range strings until the highest string is reached where, as discussed above, the associated pickup 94 is at the mid point.

Figure 13:
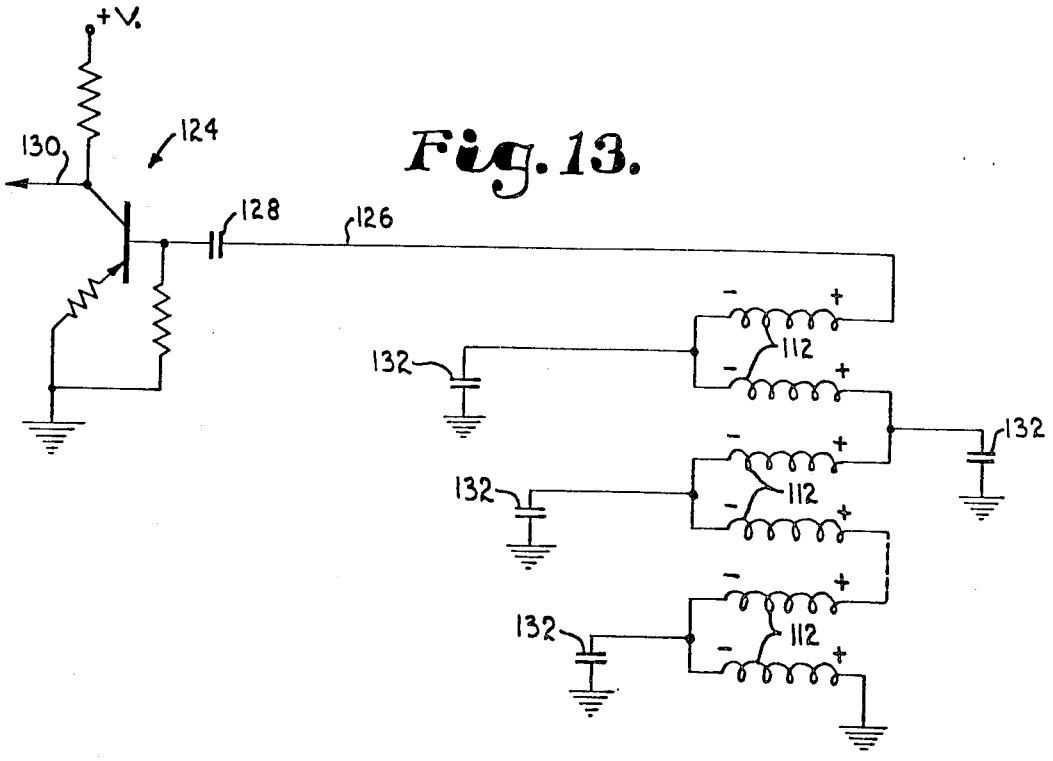
FIG. 13 is an electrical schematic diagram showing the coils of the magnetic pickups connected in the input circuitry of the audio amplifier, and the arrangement of bypass capacitors for harmonic suppression.

Referring to FIG. 13, the coils 112 of six of the magnetic pickups 94 are shown schematically, the remainder of the coils being included in the broken line notation. All of the coils 112 are connected in a series circuit across the input of an audio amplifier. The first stage of the amplifier is shown at 124; an input lead 126 extends from a coupling capacitor 128 to the first coil 112, which is the coil of the pickup 94 associated with the lowest bass string 38. The series circuit continues to common ground as indicated by the ground symbol connected to the right (plus) end of the bottom ccil 112, this being the pickup coil associated with the highest treble string 38. The plus and minus designations at the ends of the coils 112 illustrate that successive pairs of coils are oppositely wound so as to be 180° out of phase for AC hum cancellation. The amplifier stage 124 is shown as a PNP transistor amplifier having a collector output lead 130 which extends to subsequent stages (not shown). Although also not illustrated, it is to be understood that the amplifier would drive a suitable speaker system preferably mounted beneath the cover 34 in alignment with the speaker opening 32 provided therein (FIG. 1).

A bypass capacitor 132 is associated with each of the coils 112 except the top coil 112 of FIG. 13 which is the pickup coil of the lowest bass note. A value of 0.01 mfd is suitable for each of the capacitors 132. Their function is to shape the signals from the coils 112 through suppression of undesired harmonics, the suppression being effected to a progressively greater extent with increasing fundamental frequency of the pickup coil signal. The highest fundamental frequency or pitch will be characteristic of the signal produced by the pickup coil 112 associated with the highest treble string; this signal is subject to the greatest harmonic suppression since all of the capacitors 132 are effective. Although in FIG. 13 the bypass capacitors 132 begin with the coil 112 associated with the next to the lowest bass string, it may in practice be desired to omit the capacitors 132 until several notes higher on the keyboard.

OPERATION

The piano is conveniently tuned through the use of the tuning bar mechanisms illustrated in FIGS. 8 and 9. The pitch of each string 38 will be heard from the speakers driven by the audio amplifier, as will be discussed. With a wrench (such as an Allen wrench) sized to fit the heads of the socket head screws 70 and 82, the screw 70 is first adjusted if coarse tuning is required. Rotating the screw 70 has the effect of raising or lowering the fulcrum of the tuning bar or rocker 64. The screw 82 should be loosened during the coarse adjustment procedure but should not allow the tuning bar to move significantly out of the level position illustrated. Once the screw 70 is properly set, then a very fine adjustment of string tension is accomplished by rotating the end screw 82. In this manner, the precise pitch is readily obtained. Using the modified form of tuning bar mechanism shown in FIGS. 14 and 15, tuning proceeds as just described except that the fulcrum is fixed and the sole adjustment must be accomplished with the end screw 82*a*.

The slot 76 or 76*a* in conjunction with the cap screw 78 or 78*a* and recess 79 or 79*a* facilitates the installation and anchoring of the heavy wire strings encountered in pianos, particularly in the bass range. Since a piano string is highly stiff spring steel, it can only swing out and around a pin or screw to work loose. The combination of a right angle bend at the groove 76, then a wrap around the cap screw 78, and being held by the screw head in a cavity formed by recess 79 where the string cannot swing out and around, makes it impossible for the string to slip or become loose. Furthermore, it is easy to install a string. It can be hooked on at the bottom of the harp, and with no openings in the support structure to go under or through, the string is wrapped around the cap screw 78 on tuning bar 64, the screw 78 tightened, and the wire is cut from the supply reel with no waste.

Once tuned, the composite pickup output should be adjusted so as to give proper response over the keyboard spectrum. The sensitivity of the individual pickups 94 is controlled by their movable permanent magnet cores 114 (FIG. 12). These cores 114 are adjusted to set the relative amplitudes of the signals emanating from the piano strings via the pickup coils 112.

Furthermore, with a key held depressed in order to maintain the damper away from the corresponding string 38, the tone produced by the string when struck by the hammer has a characteristic attack amplitude and decay. The adjustable brackets 92, 100 and 102 provide a means of uniformly changing the attack amplitude and accompanying decay amplitude for all strings 38. Accordingly, once the individual string volumes have been set by adjusting the pickup cores 114, the pickups 94 may be shifted as a unit toward or away from the strings by adjusting the mounting screws 104, and 104*a* and the other mounting screws for the brackets 100 and 102 described hereinabove but not illustrated. Core positions closer to the strings will emphasize the attack amplitude relative to the decay amplitude but the period of the decay will be unaffected.

Once the piano is aligned for operation, the audio amplifier is operated in the usual manner by the controls provided on panel 30. In particular, the gain would be adjusted to accommodate the size of the room in which the piano is to be played.

When the piano is played, each of the strings (when struck) is caused to vibrate in a manner similar to the corresponding note string of a conventional piano that employs a soundboard. This involves vibration at the fundamental frequency of the string (the pitch of the musical note) and the generation of harmonic frequencies or overtones appropriate for that particular note on the piano, plus attack and decay characteristics and the sustain feature of the piano instrument (the sympathetic vibration of unstruck strings when the sustain pedal 26 is depressed to hold all of the dampers away from the strings). This is accomplished in the present invention through the use of the floating bridge 40 which is connected to and floats on the strings 38. It is not connected to any structure other than the strings and does not transfer vibrational energy or sound to any other electrical or mechanical device. It is employed for the purpose of placing the speaking end of each string 38 at the bridge span 56 or 58 in the proper mechanical environment in order to allow the strings to react and deliver the proper wave form when each is struck by the hammer. Characteristics concerning attack levels, decay time, and harmonic and fundamental frequency mixing can be controlled by the size, weight, density, stiffness, rigidity, bulk and position of the bridge in relationship to the harp and strings. Since there is no pressure applied to force the floating bridge against the strings and the bridge is under no tension or compression, temperature, barometric pressure and humidity have no effect on it and thus no effect on the string tuning. The bridge is held in a predetermined position since it is only in such position that all of the bridge pins 62 line up with all of the strings 38. For the bridge to move, it would have to move certain strings one direction sideways and other strings in the opposite direction sideways due to their nonparallel arrangement (see FIG. 2), which would be difficult since all the strings are stretched to a very high tension.

The bridge 40 is held in engagement with the strings 38 and is solely supported thereby, and is not otherwise held nor connected to any other structure as discussed above. Accordingly, only those forces are applied to the strings 38 resulting from the tensioning of the strings and their engagement with the maple facings of the bridge spans 56 and 58. Although there is no transfer of vibrational energy from the bridge 40, there is the desired energy transfer within the bridge from one string to other strings when a key is depressed and the sustain pedal 26 is used. Although not recommended, auxiliary supports for the bridge in the nature of straps or brackets might be used in some instances, and could be employed so long as the bridge remains in a floating state in order that its vibrational characteristics are not impaired nor significant vibrational energy lost by being grounded to external structure.

The harmonic richness and mixture of the tones of the piano are controlled by the fact that the pickups 94 are located at selected points along the active lengths of the respective strings. A conventional piano has a rich supply of harmonics in the bass section, but due to string and soundboard properties, gradually loses harmonics going up note by note to the treble and where there are few if any harmonics whatsoever. To duplicate this characteristic, special wave shaping is employed in the present invention. Initial shaping is accomplished by the positions of the pickups 94 which emphasize, according to position, certain harmonics particularly in the lower strings. Final shaping is accomplished by the capacitors 132, the impedance of each pickup coil being purposely maintained sufficiently low (on the order of 100 ohms DC resistance) that a given coil 112 is affected only by the total number of capacitors between such coil and the amplifier input lead 126. Accordingly, the capacitors 132 (FIG. 13) have a cumulative effect with increasing fundamental frequency. For example, for the highest string, all of the capacitors 132 are effectively in parallel and connected between the left end (minus sign) of the coil 112 and ground. The other coils 112 merely serve as a low impedance path to connect all of the capacitors 132 in parallel. The higher the capacitance (effectively between input lead 126 and ground), the greater the harmonic suppression.

On the other hand, looking at the coil 112 associated with the lowest bass string, there is no harmonic suppression at all since its right end (plus sign) is directly connected to the input lead 126. Now the remaining coils 112 serve as a low impedance shunt to ground and the capacitors 132 play no part in the circuit. Accordingly, as fundamental frequency increases from string to string, an additional capacitor 132 is added one step at a time until all of the capacitors 132 are effective in the circuit for the highest string as discussed above.

As oscillatory electrical signal is generated by a given coil 112 in response to vibration of its associated string 38. The string is in the magnetic field of the permanent magnet core 114 around which the coil 112 is disposed. The change in the lines of flux of the magnetic field caused by movement of the string induces a corresponding signal in the coil 112, and such signal is combined with similar signals from the coils 112 of other strings that are being played at that time. Accordingly, a composite signal is derived from the shaping circuitry preceding amplifier stage 124 and appears on the input lead 126. This composite signal contains the fundamental and harmonic frequencies being generated by the cooperative action of the strings and floating bridge, as modified by the positions of the pickups 94 and the suppressor capacitors 132, plus the other characteristics discussed above required to produce a true piano sound.

Having thus described the invention, what is claimed as new and desired to be secured by Letters Patent is:

1. In a stringed instrument where a plurality of strings under tension are employed having predetermined frequencies of vibration, and where frame means supports one end of each string and is provided with apparatus for adjusting the tension, the improvment in said apparatus comprising:

a plurality of tuning bars each having a pair of opposed ends;

means attaching said end of each string to one end of a corresponding bar;

a base provided with means supporting said bars intermediate their ends for rocking movement of each bar in directions to respectively decrease and increase the tension on the corresponding string; and selectively adjustable elements engaging the opposite ends of respective bars and secured to said base for independently holding each bar against movement under the force of the attached string and permitting adjustment of the bar to a position that will set the string at the predetermined frequency, each element and said base having mating thread means providing a fine adjustment of the tension of each string upon rotation of the corresponding element, said supporting means comprising selectively adjustable components engaging respective bars and providing a fulcrum for each bar, each of said components and said base having mating thread means providing a relatively coarse adjustment of the tension of each string upon rotation of the corresponding component.

2. In the instrument as claimed in claim 1, wherein said base is provided with shoulder means adjacent said one ends of the bars over which said strings are drawn.

3. In a stringed instrument where a plurality of strings under tension are employed having predetermined frequencies of vibration, and where frame means supports one end of each string and is provided with apparatus for adjusting the tension, the improvement in said apparatus comprising:

a plurality of tuning bars;

means attaching said end of each string to a corresponding bar;

a base provided with means supporting said bars for rocking movement of each bar in directions to respectively decrease and increase the tension on the corresponding string; and selectively adjustable means engaging respective bars and secured to said base for independently holding each bar against movement under the force of the attached string and permitting adjustment of the bar to a position that will set the string at the predetermined frequency, each bar having a cavity therein receiving said end of the corresponding string, means causing said end to undergo substantially a right-angle bend into said cavity and including a groove in the bar receiving said end at the bend and communicating with said cavity, and a fastener in said cavity about which said end is wrapped for capturing said end and retaining the same in said cavity, said fastener and cavity presenting said attaching means.

* * * * *

UNITED STATES PATENT OFFICE

CERTIFICATE OF CORRECTION

PATENT NO. : 4,044,644

DATED : August 30, 1977

INVENTOR(S) : CHARLES E. MUSSULMAN

It is certified that error appears in the above-identified patent and that said Letters Patent are hereby corrected as shown below:

In the heading, under "Related U. S. Application Data" at reference [62], the number of the prior U. S. patent should be 3,931,752 instead of 3,923,939.

In the specification, Column 1, line 4, change the patent number from "3,923,939" to --3,931,752--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*